US011208260B2

(12) United States Patent
Schweitzer et al.

(10) Patent No.: US 11,208,260 B2
(45) Date of Patent: Dec. 28, 2021

(54) BAG FOR POWDERY BULK MATERIALS

(71) Applicant: Kronos International, Inc., Leverkusen (DE)

(72) Inventors: Ulf Schweitzer, Leichlingen (DE); Christian Wolff, Monheim (DE); Harald Wohlfeld, Monheim (DE); Thomas Vels, Cologne (DE)

(73) Assignee: Kronos International, Inc., Leverkusen (DE)

( * ) Notice: Subject to any disclaimer, the term of this patent is extended or adjusted under 35 U.S.C. 154(b) by 0 days.

(21) Appl. No.: 15/788,163

(22) Filed: Oct. 19, 2017

(65) Prior Publication Data

US 2018/0148252 A1 May 31, 2018

(30) Foreign Application Priority Data

Aug. 22, 2016 (DE) ..... 102016010041.9
Jan. 10, 2017 (DE) ..... 102017000108.1
Apr. 27, 2017 (DE) ..... 202017002448.9

(51) Int. Cl.
*B65D 88/06* (2006.01)
*B65D 88/16* (2006.01)
*B65D 83/06* (2006.01)

(52) U.S. Cl.
CPC ..... *B65D 88/1668* (2013.01); *B65D 83/06* (2013.01); *B65D 88/1631* (2013.01); *B65D 88/1681* (2013.01)

(58) Field of Classification Search
CPC ..... B65D 88/16; B65D 88/1668; B65D 88/1681; B65D 88/06; B65D 88/1631; Y10S 493/927; Y10S 493/928
USPC ..... 222/181.2; 383/41, 67, 86
See application file for complete search history.

(56) References Cited

U.S. PATENT DOCUMENTS 4,194,652 A * 3/1980 Williamson ..... B65D 88/1612 112/418
4,573,204 A * 2/1986 Polett ..... B65D 88/1668 222/105
4,691,371 A * 9/1987 Derby ..... B65D 88/1668 222/530
4,710,967 A * 12/1987 Petschner ..... B65D 88/1618 206/806
4,917,266 A * 4/1990 Kellenberger ..... B65D 88/1668 222/105
4,917,507 A * 4/1990 Davidson ..... B65D 88/1612 383/121
5,484,207 A * 1/1996 Schnaars ..... B65D 88/1668 383/67

(Continued)

FOREIGN PATENT DOCUMENTS

DE 3223539 12/1983
DE 102010062225 5/2012

(Continued)

*Primary Examiner* — Vishal Pancholi
*Assistant Examiner* — Robert K Nichols, II
(74) *Attorney, Agent, or Firm* — Mark R. Backofen; Charles E. Phipps; Robert E. Nail

(57) ABSTRACT

The invention is directed to a bag for transporting and handling powdery bulk materials, especially inorganic or organic pigments. Further, the present invention relates to a method for opening the tubular drain of such a bag, as well as to the use of the bag for transporting and handling powdery bulk materials.

17 Claims, 4 Drawing Sheets

(56) References Cited

U.S. PATENT DOCUMENTS

| | | | | |
|---|---|---|---|---|
| 6,048,296 | A * | 4/2000 | Futerman | B65D 88/1618 493/217 |
| 6,305,845 | B1 * | 10/2001 | Navin | B65D 88/1618 383/109 |
| 6,431,753 | B1 | 8/2002 | Rogers et al. | |
| 6,467,955 | B1 * | 10/2002 | Kim | B65D 88/1612 383/105 |
| 6,834,995 | B1 * | 12/2004 | Stevens | B65D 88/1668 383/24 |
| 2003/0099796 | A1 | 5/2003 | Levi | |
| 2004/0004804 | A1 | 1/2004 | Levi | |
| 2005/0167456 | A1 * | 8/2005 | Levi | B65D 88/1668 222/566 |
| 2006/0104546 | A1 * | 5/2006 | Combes | B65D 88/1631 383/38 |
| 2016/0264305 | A1 * | 9/2016 | Tanimoto | B65D 88/1668 |

FOREIGN PATENT DOCUMENTS

| | | |
|---|---|---|
| DE | 202016001072 | 4/2016 |
| WO | 2013070516 | 5/2013 |

* cited by examiner

BAG FOR POWDERY BULK MATERIALS

RELATED APPLICATION

This application claims the benefit of German Patent Application No. 10 2016 010 041.9 filed on Aug. 22, 2016 and now abandoned, German Patent Application No. 10 2017 000 108.1 filed on Jan. 10, 2017 and German Patent Utility Model Application No, 20 2017 002 448.9 filed on Apr. 27, 2017.

BACKGROUND

Field of the Invention

The invention is directed to a bag for transporting and handling powdery bulk materials, especially inorganic or organic pigments. Further, the present invention relates to a method for opening the tubular drain of such a bag, as well as to the use of the bag for transporting and handling powdery bulk materials.

Technological Background of the Invention

In many fields of technology, powdery bulk materials are prepared and filled into bags for transport and handling. A safe transport without spilling, the quick discharging of the bulk material without spilling, and working safety are central aspects. Conventional bags for bulk materials have unsafe discharging mechanisms that open spontaneously and inadvertently during transport or the loading and unloading of vehicles. This may result in a loss of the bulk material and, depending on the kind of bulk material, in a hazard to the environment and humans. Such bags are usually lifted by means of a device or a vehicle, such as a forklift truck, above the vessel or device into which the bulk material is to be discharged. Usual discharging mechanisms of such bags require that the mechanisms be opened manually, while the opening person has to dwell below the bag. This may result in undesirable contact with the bulk material and a hazard to humans. Thus, there is a need for a discharging mechanism that ensures a quick, complete and safe discharging of the bulk material contained in the bag without the discharging mechanism being able to open spontaneously and inadvertently.

BRIEF DESCRIPTION OF THE INVENTION

It is the technical object of the invention to provide a bag for transporting powdery bulk materials that can be discharged quickly, completely and safely and has a discharging mechanism that cannot open spontaneously and inadvertently.

This object is preferably achieved by a bag for transporting and handling powdery goods, including:

(i) a fabric bag having a top segment (1), several side segments (2), and a bottom segment (3), which together bound a storing space between them, wherein said top segment (1) has a first opening (4), and said bottom segment (3) has a second opening (6) with a tubular drain (7), and (ii) a fabric flap (8) attached to the bag on one side of said bottom segment (3) and designed to cover the second opening (6) and the tubular drain (7) completely and to be attachable on the opposite side of the bottom segment (3) by a closing means (9), characterized in that:

said tubular drain (7) is surrounded by a first cord (10) in such a way that said tubular drain (7) can be closed by means of a cord lock (11) through which said first cord (10) is led, and said first cord (10) is connected to a first release cord (12), and said cord lock (11) is connected to a second release cord (13) in such a way that said cord lock (11) can be unlocked by pulling said second release cord (13).

The bag according to the invention has a safe discharging mechanism that will not open spontaneously and inadvertently during transport and handling, or spill the bulk material contained therein. Further, the discharging mechanism of the bag according to the preferred embodiments of the invention has such a design that it can be opened without the opening person having to dwell below the bag, but can operate said mechanism while the opening person can dwell beside the bag, and thus will not inadvertently come into contact with the bulk material. Consequently, this prevents a risk of injury from contact with the bulk material.

Therefore, in a first aspect, the preferred embodiment of the invention is directed to a bag for transporting and handling powdery goods, including:

(i) a fabric bag having a top segment (1), several side segments (2), and a bottom segment (3), which together bound a storing space between them, wherein said top segment (1) has a first opening (4), and said bottom segment (3) has a second opening (6) with a tubular drain (7), and (ii) a fabric flap (8) attached to the bag on one side of said bottom segment (3) and designed to cover the second opening (6) and the tubular drain (7) completely and to be attachable on the opposite side of the bottom segment (3) by a closing means (9), characterized in that:

said tubular drain (7) is surrounded by a first cord (10) in such a way that said tubular drain (7) can be closed by means of a cord lock (11) through which said first cord (10) is led, and said first cord (10) is connected to a first release cord (12), and said cord lock (11) is connected to a second release cord (13) in such a way that said cord lock (11) can be unlocked by pulling said second release cord (13).

In another aspect, the preferred embodiment of the invention relates to a method for opening a closed tubular drain (7) of a second opening (6) in the bottom section (3) of a bag claimed herein comprising the steps (i) unfolding the fabric flap (8) at the bottom section (3) by opening the closing means (9), (ii) pulling the first release cord (12) so that the knot unravels, the knot being formed by the first cord (10), and the first cord (10) surrounds both the tubular drain (7) and the part of the tubular drain (7) that is folded up towards the bottom segment (3), and closes them with a knot with an extractor loop, and (iii) pulling the second release cord (13) so that the cord lock (11) and the tubular drain (7) of the second opening (6) open.

Finally, in a further aspect, the preferred embodiment of the invention is directed to the use of a bag claimed herein for transporting and handling powdery goods, preferably inorganic or organic pigments, particularly preferably pigments comprising titanium dioxide.

Further advantageous embodiments of the invention are stated in the depending claims.

BRIEF DESCRIPTION OF FIGURES

For a more complete understanding of the present invention and for further advantages thereof, reference is now made to the following description taken in conjunction with the accompanying drawings in which.

DESCRIPTION OF THE PREFERRED EMBODIMENTS

Figure 1:
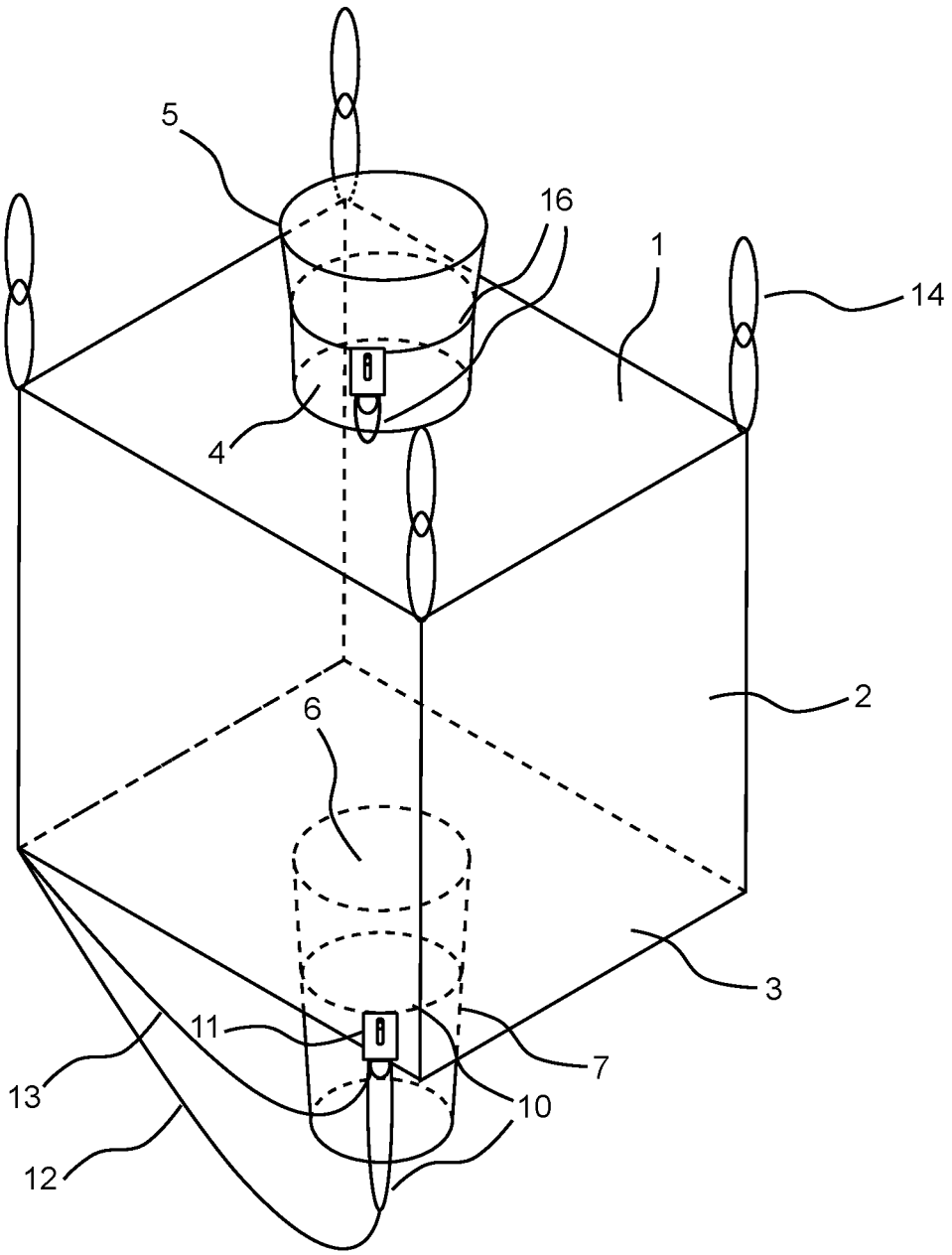
FIG. 1 is a schematic representation of a preferred bag according to the invention with opened tubular drain (7) without fabric flap (8) and closing means (9)

These and further aspects, features and advantages of the invention are evident to the skilled person by perusing the following detailed description and claims. Each feature from one aspect or embodiment of the invention may be employed in each other aspect of the invention. Numerical ranges stated in the format "from x to y" include the mentioned values as well as the values within the range of the respective measuring error as known to the skilled person. If several preferred numerical ranges are stated in such format, then of course all ranges formed by combining the different end points are also included.

All statements disclosed in the following and relating to the size in m, μm etc. or % etc. are to be understood in such terms that all values within the range of the respective measuring error as known to the skilled person are also included. The use of the term "about" is intended to encompass all values that lie within the range of the respective measurement accuracy known to the skilled person.

"At least one" as used herein means 1 or more, i.e., 1, 2, 3, 4, 5, 6, 7, 8, 9, or more.

In a preferred embodiment, the bag according to the invention includes a fabric bag having a top segment (1), several side segments (2), and a bottom segment (3), which together bound a storing space between them. The fabric bag may have any shape, for example, a sac or balloon shape, or an angular shape. Preferably, the fabric bag has an angular shape, more preferably an octagonal one. The bottom segment (3) is preferably quadrangular. The edges of the fabric bag may be reinforced by a reinforcing material and thus provide stiffness to the fabric bag.

The material of the fabric bag may be a textile material, plastic sheet, paper, or mixtures thereof, also in the form of laminates. "Textile material" as used herein relates to textile raw materials, such as natural fibers and chemical fibers, and non-textile raw materials that are processed into one-, two- and three-dimensional items by appropriate processes. These materials include without limitation polyester, polypropylene, and nylon. These materials may further be woven.

In addition, the material may be coated with another material, such as polyvinyl chloride or Teflon. In a preferred embodiment, the fabric bag has electrically conducting fabric threads. This is advantageous, in particular, if photocatalytically active or statically chargeable goods, such as titanium dioxide in anatase polymorph, are transported and handled. For this purpose, in general, all electrically conducting fabric threads known in the prior art and suitable for this purpose can be employed. Preferably, these fabric threads are incorporated in geometrical patterns in and/or on the fabric bag, such as checkered patterns.

The height, width and depth of the fabric bag can be selected arbitrarily and matched to the volume of the respective bulk material that is to be transported and handled by means of the bag. Preferably, the height, width and depth of the fabric bag are respectively a length of from 0.1 to 2 m, preferably from 0.5 to 1.5 m, and more preferably 1 m. In a preferred embodiment, the edge lengths of the fabric bag are 1.1 m high, 0.85 m wide, and 1.08 m deep. Preferably, the fabric bag is in addition octagonal, more preferably cuboid.

As can be seen in FIG. 1, in a preferred embodiment the fabric bag has a first opening (4) in the top segment (1). This first opening (4) is used for filling the bag according to the invention and can have any geometrical shape that is suitable for filling, such as angular or round. Preferably, the first opening (4) is round. Further, the first opening (4) is preferably positioned centrally in the top segment (1) and has a diameter of from 0.01 to 1 m, preferably from 0.25 to 0.75 m, more preferably 0.6 m. In a preferred embodiment, the first opening (4) has a tubular filler (5). This filler has such a design that it supports the filling of the bulk material into the fabric bag. Thus, said filler may have such a shape that it can be put over the outlet of a filling machine, such as an angular or round shape, preferably a round shape.

The tubular filler (5) may have a cylindrical or conical shape, the diameter being the same as that of the first opening (4). The height is from 0.1 m to 1 m, preferably from 0.3 m to 0.6 m, more preferably 0.5 m. Preferably, the tubular filler (5) is mounted flush to the first opening (4). Preferably, said filler (5) has a conical shape at first, the tubular filler (5) becoming narrower, the closer it gets to the top segment (1). The diameter of the tubular filler (5) decreases from 80 to 50%, preferably 60%, of the diameter of the widest part of the filler that is furthest from the top segment (1). The tapering goes over 40 to 60%, preferably 50%, of the entire height of the filler (5). Over the remaining height, the filler (5) has a cylindrical shape with a constant diameter. Preferably, the filler (5) is mounted flush to the first opening (4). Further, the material of the filler (5) may be the same as or different from that of the fabric bag, preferably an identical material. In a preferred embodiment, the filler (5) has a diameter of 0.6 m that tapers down to 0.36 m.

Further, a top cord (16) surrounds the filler (5) in such a way that the filler (5) can be closed by means of this top cord (16). This is preferably effected by pressing this filler together and closing it. The closing can be effected by means of conventional techniques or devices, such as a usual cord lock, or by knotting the top cord (16). The closed form of the filler (5) is particularly suitable when the bag has been filled and is being transported or handled.

Figure 6:
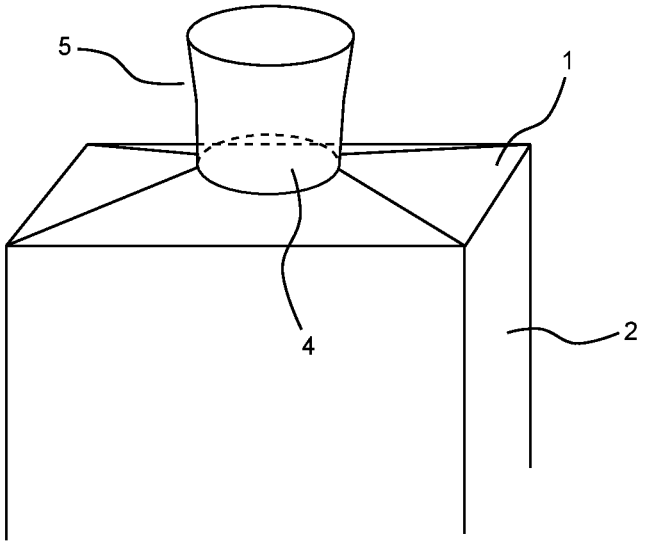
FIG. 6 is a schematic representation of an alternate top segment (1) of the preferred bag of FIG. 1 including the tubular filler (5), wherein said top segment (1) has a pyramidal shape, and the storing space is thus enlarged.

In another preferred embodiment, as depicted in FIG. 6, the top segment (1) is designed in a pyramidal shape so that the storing space is larger than it would be without the pyramidal shape. In this case, the top segment (1) is designed in a pyramidal shape rather than as a sheet. The side segments (2) and the top segment (1) form edges. These edges and the first opening (4) form the pyramidal shape. This pyramidal shape ensures a quicker and more uniform filling of the bag. Further, the filled bag can be pressed after filling, so that the bulk material has an increased bulk density over that without the bag being pressed. The bag can thus be filled with more bulk material, and used optimally.

Further, the fabric bag has a bottom segment (3) having a second opening (6) with a tubular drain (7). This second opening (6) is used for discharging the bag according to the invention and can have any geometrical shape that is suitable for this, such as an angular or round shape. Preferably, the second opening (6) is round. Further, the second opening (6) is preferably positioned centrally in the bottom segment (3) and has a diameter of from 0.01 to 1 m, preferably from 0.25 to 0.75 m, more preferably 0.6 m. The tubular drain (7) is preferably mounted flush to the second opening (6). Further, the material of the tubular drain (7) may be the same as or different from that of the fabric bag, preferably an identical material. This drain has such a design that it supports the discharging of the bulk material, and may have a shape that it suitable for this, such as an angular or round shape. Thus, the tubular drain (7) may have a cylindrical shape, the diameter being the same as that of the second opening (6). The height of the tubular drain (7) is from 0.1 m to 1.5 m, preferably from 0.4 m to 1.1 m, more preferably 0.7 m. Preferably, the tubular drain (7) tapers down to 75% over the entire height, so that discharging without spilling is ensured.

The tubular drain (7) is further surrounded by a first cord (10), which is led through a cord lock (11). Further, one end of a first release cord (13) is connected to the first cord (10). A end of a second release cord (13) is connected to the cord lock (11) in such a way that said cord lock (11) can be unlocked by pulling said second release cord (13). Such cord locks are well established in the prior art. The opposite ends of the first release cord (12) and the second release cord (13), i.e. the ends not connected to the first cord (10) or the cord lock (11), are attached to the fabric bag at the same site. Preferably the opposite ends of the first release cord (12) and second release cord (13) are connected to the fabric bag in such a way that those who operate the release cords can operate them while they are positioned beside the bag according to the invention. More preferably, the release cords (12) and (13) are attached to the bag where one of said several side segments (2) is connected to said bottom segment (3). In order to improve the orientation for those who operate the release cords, one side segment (2) may be marked, for example, printed with a marking sign, so that the release cords (12) and (13) can be more easily located. Preferably, the release cords (12) and (13) are attached to the lower right corner of the marked side segment (2), as viewed from the bag.

Figure 3:
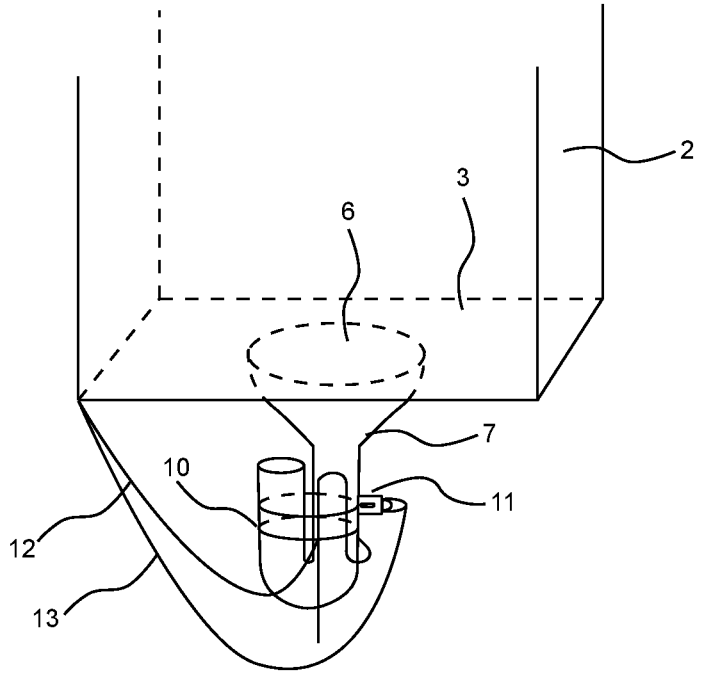
FIG. 3 is a schematic representation of the lower portion of the preferred embodiment of FIG. 1 depicting a closed tubular drain (7)
Figure 4:
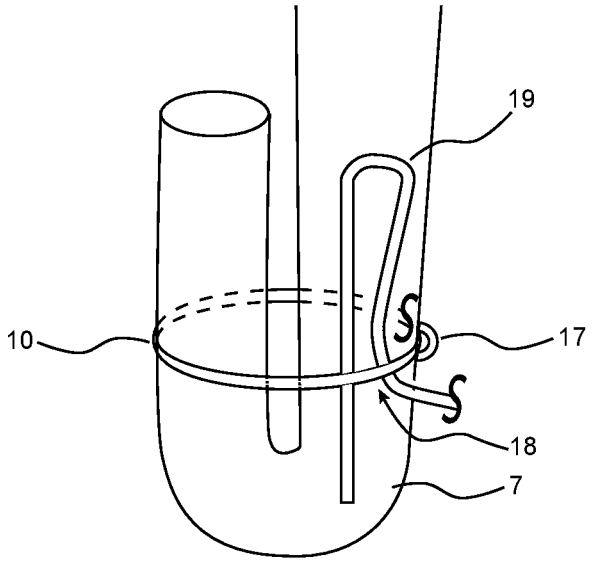
FIG. 4 is an expanded schematic representation of the preferred embodiment of FIG. 1 depicting a closed knot with an extractor loop formed by the first cord (10), surrounding the tubular drain (7) and the part of the tubular drain (7) that is folded up towards the bottom segment (3), pressing it together and thus closing it. The schematic representation does not show the cord lock (11) or the entire cord (10)

As can be better seen in FIGS. 3-4 and 6, the first cord (10) surrounds the tubular drain (7) in such a way that said tubular drain (7) can be closed by means of said first cord (10) and cord lock (11). As can be seen in FIG. 4, preferably, said tubular drain (7) has at least one loop (17) that is attached to said tubular drain (7) in such a way that said first cord (10) is led through said at least one loop (17). The first cord (10) is secured thereby, facilitating the closing of the tubular drain (7). Said at least one loop (17) is preferably attached to said tubular drain at 33% of the total height of the tubular drain (7) from the bottom segment (3). Alternatively, said at least one first cord (10) can be attached, for example, sewn, adhesive-bonded or riveted, to said tubular drain (7).

Figure 2:
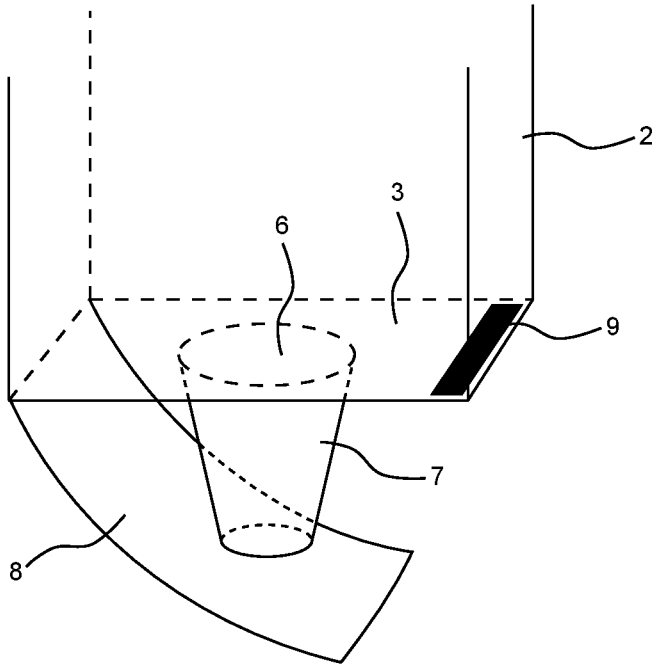
FIG. 2 is a schematic representation of the lower portion of the preferred embodiment depicted in FIG. 1 further depicting an opened tubular drain (7) with fabric flap (8) and closing means (9)

Further, as can be seen in FIG. 2, the preferred bag according to the invention has a fabric flap (8) attached to the bag on one side of the bottom segment (3) and designed to cover the second opening (6) and the tubular drain (7) completely and to be attachable on the opposite side of the bottom segment (3) by means of a closing means (9). The closing means (9) is preferably a hook-and-loop fastener, but can be any other known attachment mechanism. The closing means (9) may be attached directly to the bottom segment (3), or to a flap attached to the bottom segment (3) of the fabric bag. Further, the closing means may extend over the entire length or part of a side segment of the side segments (2). Preferably, the closing means (9) is attached flush to an edge formed by the bottom segment (3) and a side segment (2). If the bottom segment (3) has an angular shape, then the width of the fabric flap is from 60 to 100%, preferably from 70 to 90%, more preferably 80%, of the side length of the bottom segment, but at least as wide that the fabric flap (8) covers the second opening (6) completely. Preferably, the fabric flap (8) has such a length that it covers the second opening (6) and the tubular drain (7) completely when the tubular drain (7) is closed, as herein described. The fabric flap (8) can be made of any material known in the prior art and suitable for this purpose. Preferably, the material of the fabric flap (8) is identical with that of the fabric bag.

Figure 7:
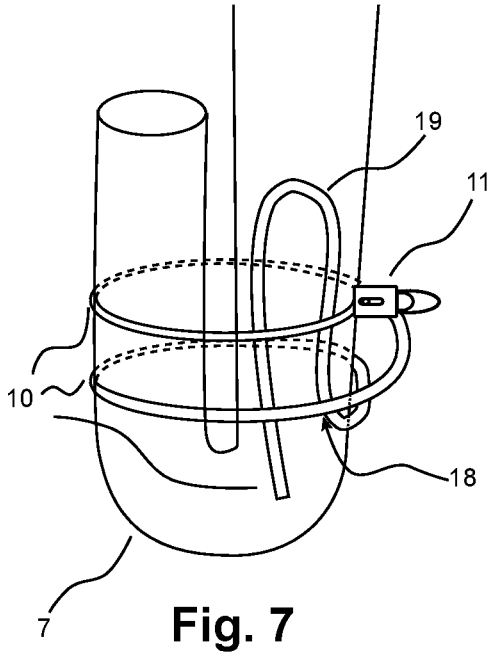
FIG. 7 is a schematic representation of the preferred embodiment of FIG. 1 depicting a closed knot with extractor loop formed by the first cord (10), surrounding the tubular drain (7) and the part of the tubular drain (7) that is folded up towards the bottom segment (3), pressing it together and thus closing it, including the cord lock (11).

In a preferred embodiment, the tubular drain (7) is narrowed by means of the first cord (10) and the cord lock (11), through which the first cord (10) is led, and the tubular drain (7) is folded towards the bottom segment (3) below the cord lock (11), and the first cord (10) surrounds both the tubular drain (7) and the part of the tubular drain (7) that is folded towards the bottom segment (3), and closes it with a knot (18) with an extractor loop (19) in such a way that said knot (18) with an extractor loop (19) can be undone by pulling the first release cord (12) as can been better seen in FIG. 7. In this case, the first cord (10) has several functions: In the first function, the first cord (10) surrounds the tubular drain (7) and narrows it together with the cord lock (11). In the second function, the part of the first cord (10) that does not close the tubular drain (7) together with the cord lock (11) surrounds the narrowed tubular drain (7) and the part of the tubular drain (7) that is folded towards the bottom segment (3) in such a way that the part of the first cord (10) forms a knot (18) with an extractor loop (19), and that the knot (18) with an extractor loop (19) can be undone by pulling the first release cord (12). Both the tubular drain (7) and the part that is folded towards the bottom segment (3) form a gooseneck. Both run in parallel and are in contact with one another. In general, all knots with an extractor loop as known in the prior art that are suitable for this purpose can be used. These include, in particular, an overhand knot with draw-loop, which is also known under the designation slipped overhand knot. FIG. 3 shows such a knot (18). The bag according to the invention is in this state preferably when it has been filled and is being transported or handled. The tubular drain (7) is opened immediately before discharging, and the material contained in the bag flows from the fabric bag through the second opening (6) and the tubular drain (7).

Figure 5:
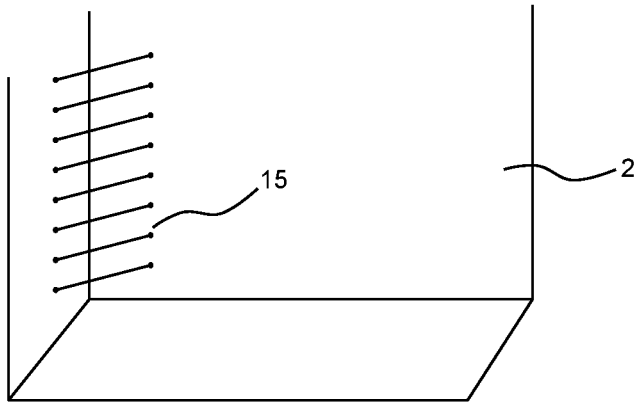
FIG. 5 is a schematic representation of a portion of an alternate version of the preferred bag of FIG. 1 further containing a plurality of horizontal strings (15) within the storing space that connect two adjacent side walls and thereby stabilize the bag. The thread length is 25% to 50% of the width of a side segment of said several side segments (2)

As can be better seen in FIG. 5, preferably, two adjacent side walls (2) are connected within the storing space by means of a plurality of threads (15). Preferably, said threads (15) are attached horizontally to said two adjacent side walls (2). A "plurality" as used herein refers to a number of from 2 to 100, preferably from 25 to 75, and more preferably, to the number 50. The length of the threads is 25 to 50% of the width of a side segment (2) of the bag. The plurality of threads (15) are preferably sewn to the fabric bag in a zigzag pattern. The bag is stabilized thereby, and excess deformation in an at least partially filled state is prevented. This enables an advantageous shape for transport after the bag has been filled. Further, the bag is stabilized thereby. The filled bags are usually compressed for transport in order to save volume. In doing so, these threads (15) are advantageous, because of their flexible shape, over conventional rigid connections that interconnect the side segments, since such rigid connections are damaged during compression.

As can be seen in FIG. 1, in a preferred embodiment, the fabric bag has a multiple loop (14), preferably a double loop, on each of the corners of the top segment (1). A "multiple loop", as used herein, refers to a loop through which another loop is pulled. The other loop is always pulled through the loop that was pulled through immediately before. The multiple loop (14) serves for hanging on a device or vehicle, such as a forklift truck. The bag can be transported thereby, among other things, and lifted above the vessel or device into which it is to be discharged. Each loop of said multiple loop (14) has a diameter common for such a case, for example, from 5 to 30 cm, preferably from 10 to 20 cm. The loops of the multiple loop (14) can have different sizes. Thus, the loop that is attached to the fabric bag may have a diameter that is larger than that of said other loop.

Preferably, the first release cord (12) and the second release cord (13) have different colors. More preferably, the first release cord (12) is black, and the second release cord (13) is red.

The first and second cords (10) and (16), said first and second release cords (12) and (13), the plurality of threads (15), the at least one loop (17) as well as the multiple loop (14) are made of a tear-resistant and flexible material that is known in the prior art and is usually used for this purpose. These include, without being limited thereto, polypropylene, polyester, and nylon, which may also be woven.

The present invention includes both the completely emptied bag and the at least partially filled bag. Further, the present invention includes each of the filler (5) and the tubular drain (7) in both the opened and closed states.

The bag is particularly suitable for several uses, preferably for 2 to 20, more preferably 4 to 10, even more preferably 6, uses, because of, among other things, the discharging mechanism comprising the tubular drain (7), the first cord (10) and the knot with an extractor loop formed by the first cord (10), the cord lock (11) of the first release cord (12) and the second release cord (13), and the fabric flap (8).

The bag according to the invention is suitable for transporting and handling powdery bulk materials, such as pigments, fillers, granules and pellets. These also include foods, such as rice, maize, cereals and sugar. Inorganic or organic pigments are particularly suitable for this, more preferably pigments comprising titanium dioxide. Further, the bag disclosed herein is more suitable for fine-grained bulk materials having a size of preferably less than 500 μm, more preferably less than 100 μm, even more preferably less than 1 μm, and most preferably less than 0.5 μm, because of its quality.

In another aspect, the invention relates to a method for opening a closed tubular drain (7) of a second opening (6) in the bottom section (3) of a bag claimed herein comprising the steps of:

(i) unfolding the fabric flap (8) at the bottom section (3) by opening the closing means (9), (ii) pulling the first release cord (12) so that the knot unravels, the knot being formed by the first cord (10), and the first cord (10) surrounds both the tubular drain (7) and the part of the tubular drain (7) that is folded up towards the bottom segment (3), and closes them with a knot with an extractor loop, and (iii) pulling the second release cord (13) so that the cord lock (11) and the tubular drain (7) of the second opening (6) open. The method ensures a complete, rapid emptying of the bag, whereby the person opening the bag does not to dwell below the bag, but can be located beside said bag during the emptying of the bag, thus not coming into contact with the bulk material and not being endangered. Preferably, the method is carried out while the bag is above the container or the device into which the bulk material is to be emptied.

Finally, in a further aspect, the invention is directed to a bag claimed herein for transporting and handling powdery goods, preferably inorganic or organic pigments, particularly preferably pigments comprising titanium dioxide.

The above descriptions of certain embodiments are made for the purpose of illustration only and are not intended to be limiting in any manner. Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is being claimed is:

1. A bag for transporting and handling powdery goods comprising:

a fabric bag having a top segment, one or more side segments, and a bottom segment, wherein the segments together bound a storing space between them;

wherein said top segment has a first opening, and said bottom segment has a second opening;

a tubular drain connected to the bottom opening;

a fabric flap attached to the bag on one side of said bottom segment and selectively attached to a second side of the bottom segment so the fabric flap completely covers the second opening and the tubular drain when attached to the second side of the bottom segment;

wherein when the tubular drain is in a closed position, a first portion of a first cord surrounds the tubular drain and passes through a cord lock in a manner to narrow and close off the tubular drain;

wherein an end of the tubular drain is folded below the cord lock back toward the bottom segment of the bag to form a first portion of the tubular drain extending away from the bottom segment and a second portion of the tubular drain extending toward the bottom segment;

wherein a second portion of the first cord further surrounds both the first and second portions of the tubular drain;

a first release cord is connected to the second portion of the first cord;

a knot formed in the first cord, wherein pulling the first release cord undoes the knot to release the second portion of the first cord from around the first and second portions of the tubular drain;

a second release cord is connected to the cord lock such that the cord lock can be unlocked by pulling the second release cord.

2. The bag according to claim 1, further comprising at least one loop attached to the tubular drain and wherein at least when the tubular drain is in a closed position the first cord passes through the at least one loop.

3. The bag of claim 1 wherein the bag has at least two side segments.

4. The bag of claim 3, further comprising a plurality of threads attaching adjacent side segments to further stabilize the bag, wherein each of the threads is from about 25 to about 50 percent of the width of the side segments.

5. The bag of claim 3, wherein the bag has a shape selected from the group consisting of octagonal and cuboid shapes.

6. The bag of claim 1 wherein the bottom segment is quadrangular.

7. The bag of claim 1 further comprising a hook and loop fastener that selectively attaches the fabric flap to the second side of the bottom segment.

8. The bag of claim 1 further comprising at least two multiple loops attached the top segment.

9. The bag of claim 1 further comprising electrically conductive fabric threads woven in at least one of the bag segments.

10. The bag of claim 1, wherein the top segment has a pyramid shape, thereby increasing the size of the storing space.

11. The bag of claim 1 further comprising:

a tubular filler attached to the first opening in the top segment; and a second cord surrounding the filler to selectively narrow and close the filler.

12. The bag of claim 1 further comprising a pigment at least partially filling the storing space.

13. The bag of claim 12 wherein the pigment at least partially comprises titanium dioxide.

14. The bag of claim 2 further comprising:

a tubular filler attached to the first opening in the top segment;

a second cord surrounding the filler to selectively narrow and close the filler;

electrically conductive fabric threads woven in at least one of the bag segments wherein the bag has an angular shape and at least three side segments;

at least two multiple loops attached the top segment at corners formed by adjacent side segments;

a plurality of threads attaching adjacent side segments to further stabilize the bag, wherein each of the threads is from about 25 to about 50 percent of the width of the side segments; and wherein the top segment has a pyramid shape, thereby increasing the size of the storing space.

15. A method for opening a closed tubular drain in the bag of claim 2 comprising the steps of:

(i) uncovering the second opening and the tubular drain by detaching the fabric flap from the second side of the bottom segment;

(ii) pulling the first release cord to undo the knot, thereby allowing the tubular drain to unfold, and (iii) pulling the second release cord to unlock the cord lock and open the tubular drain.

16. The method of claim 15 wherein steps (ii) and (iii) are performed without the operator being underneath the bag.

17. The bag of claim 1 wherein the knot is a slipped overhand knot containing an extractor loop.

* * * * *